United States Patent [19]

Rovere

[11] 3,933,317

[45] Jan. 20, 1976

[54] GRINDING MILL

[76] Inventor: Virgilio Rovere, 33010 Magnano in Riviera, via Chiesa N.4, Udine, Italy

[22] Filed: Aug. 12, 1974

[21] Appl. No.: 496,623

Related U.S. Application Data

[63] Continuation-in-part of Ser. No. 378,080, July 11, 1973, abandoned.

[52] U.S. Cl. ..... 241/246; 241/259.1; 241/261; 241/261.1

[51] Int. Cl.[2] ..... B02C 4/10; B02C 4/32

[58] Field of Search ..... 241/245, 246, 259.1, 260, 241/261, 261.1

[56] References Cited

UNITED STATES PATENTS

| | | | |
|---|---|---|---|
| 342,802 | 6/1886 | Marshall | 241/259.1 X |
| 366,165 | 7/1887 | Gray | 241/246 |
| 858,354 | 6/1907 | Sharpneck | 241/246 X |
| 3,249,310 | 3/1966 | Willems | 241/245 X |
| 3,514,079 | 5/1970 | Little, Jr. | 241/261.1 X |
| 3,523,799 | 8/1970 | Rigby | 241/246 X |
| 3,533,563 | 10/1970 | Eriksson | 241/261 X |

*Primary Examiner*—Granville Y. Custer, Jr.
*Assistant Examiner*—Howard N. Goldberg
*Attorney, Agent, or Firm*—Wolf, Greenfield & Sacks

[57] ABSTRACT

The mill includes coaxial inner and outer cones mounted in telescopic relationship, each having facing helical ribs with the ribs on one cone crossing the ribs on the other cone so that material received intermediate the two cones at the apex of the cones passes to the base. The two cones are preferably relatively adjustable to control particle size.

4 Claims, 2 Drawing Figures

GRINDING MILL

RELATED APPLICATION

This is a continuation-in-part of application Ser. No. 378,080 filed July 11, 1973, now abandoned.

BACKGROUND OF THE INVENTION

The present invention relates to grinding mills which are particularly, although not exclusively useful for grinding crushed coal, ore, stones, clay and other similar materials. More particularly, the present invention relates to a grinding mill of the coaxial two cone type.

Grinding mills have previously been proposed which have coaxial, telescopic cones but which are extremely complicated and which operate at a high speed. In all cases it is the internal cone which rotates and this prevents the construction of large mills or crushers because the stress on the internal cone prevents a suitable constructional arrangement. It is also found in this type of mill that cones become worn out fast and this makes the machine expensive to operate.

With the mill of the present invention it is possible, under some circumstances to reduce the complexity of the machine whilst increasing its productivity, reducing the unkeep cost, permitting the dimensions to be increased, and finally making it possible to crush, grind or otherwise reduce any material which it may be desired to treat, even in the most difficult cases which cannot be dealt with by the previously proposed mills.

SUMMARY OF THE INVENTION

According to the present invention a grinding mill comprises two coaxial cones, the cones being mounted in telescopic relationship so that the distance between the walls of the cones gradually decreases from the apex to the base, the outer cone having internal helical ribs and the inner cone having external helical ribs, the ribs on one cone crossing the ribs on the other cone so that material passing between the two cones is conveyed from the apex to the base.

The mill may include an inlet for material to be ground, the inlet containing two further sets of crossing helical ribs to force the material in the inlet towards the two cones.

The use of crossing helical ribs makes it possible to avoid the disadvantage which often occurs with the grinding of pasty material such as, for example, clay, which easily blocks the feed inlet. The device of the present invention with the helical ribs is also suitable for friable material.

In accordance with another aspect of the present invention the position of the internal cone is adjustable relative to the external cone making it possible to regulate the particle size of the material processed.

DESCRIPTION OF THE DRAWINGS

Numerous other objects, features and advantages should now become apparent upon a reading of the following detailed description taken in conjunction with the accompanying drawings, in which.

DETAILED DESCRIPTION

Figure 1:
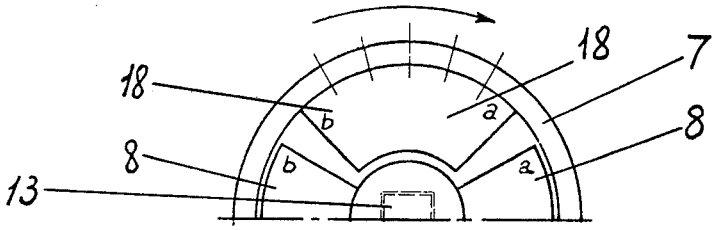
FIG. 1 is a top plan view of an inlet to the grinding mill of this invention.
Figure 2:
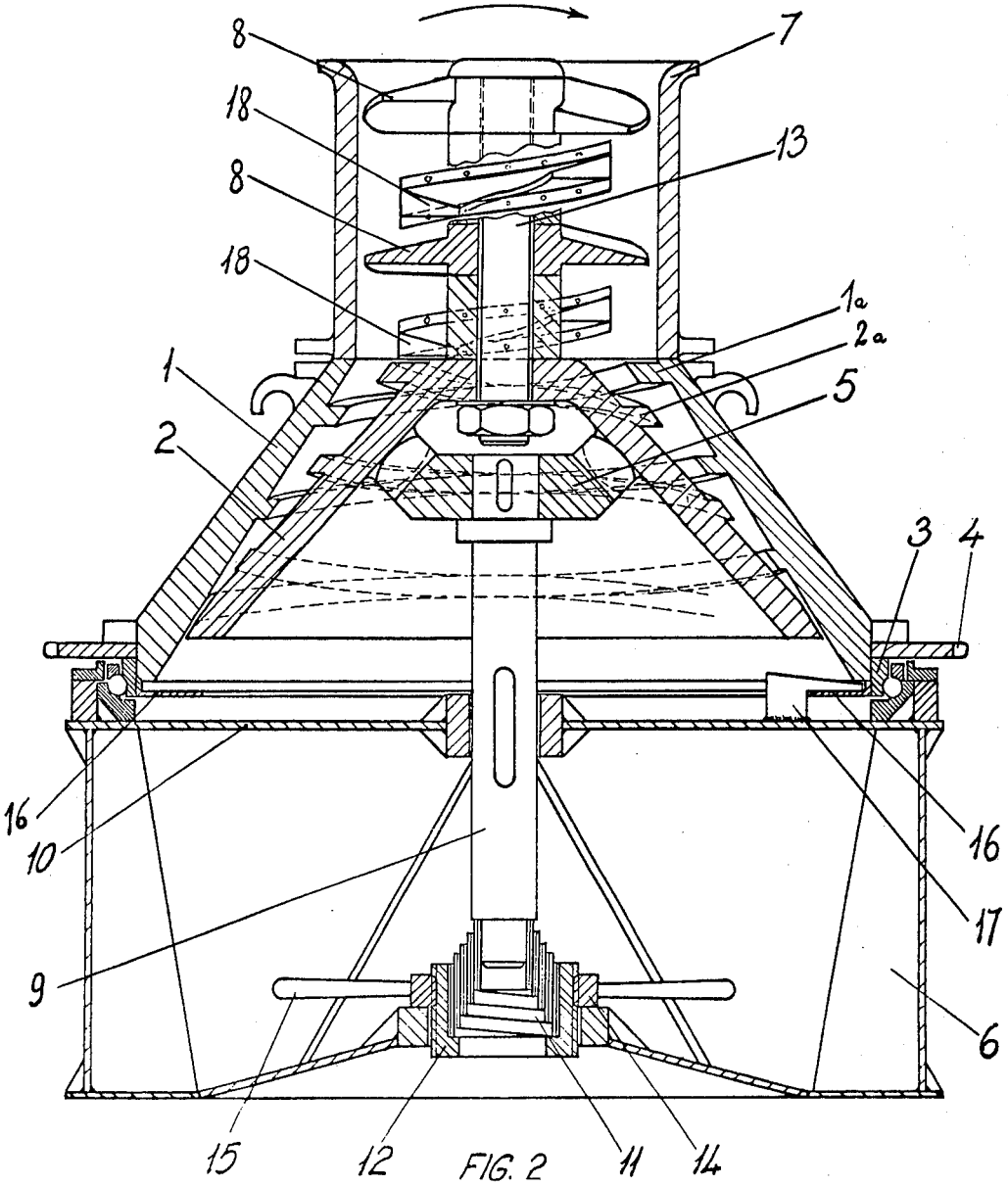
FIG. 2 is an axial section view through a mill constructed in accordance with the principles of this invention.

The mill comprises a frame including an upright support member 6 and a horizontal plate member 10 which together are interconnected and support an external rotary cone 1 having helical internal ribs 1*a*, and an internal cone 2 also having helical ribs 2*a*. The ribs 1*a* extend in the reverse direction to the ribs 2*a*. The ribs 1*a*, for example, may form a right-hand screw/thread whereas the ribs 2*a* form a left-hand screw/thread.

The cone 2 is maintained in a non-rotatable position on toothed support 5 so that during rotation of the cone 1 a sheering effect is produced and a substance passing downwardly between the two cones is ground increasingly finer as the walls of the two cones converge. The toothed support 5 does not rotate and neither does the cone 2 but by means of the support 5 and the shaft 9 the cone 2 is adjustable to different positions relative to the cone 1 as discussed in more detail hereinafter.

The external cone 1 rotates on an abutment 3 by means of toothed wheel or gear 4 which mates with a toothed portion of the abutment. The cone 1 is suitably supported by bearing means from the frame. A suitable motor with reduction gearing may couple to toothed wheel 4 for driving the cone 1.

The upper portion of the cone 1 has a feed inlet 7 which rotates with the cone 1. Screw elements 18 (see FIG. 1) are fastened to the internal walls of the inlet 7. These elements are disposed about a portion of the circumference of the inlet 7, as indicated in FIG. 1, and these elements have a helical configuration similar to the ribs 1*a* of cone 1. Because the inlet 7 rotates with the cone 1, the elements 18 also are rotatable therewith.

Screw elements 8 are carried by a shaft 13 which extends coaxially of the internal cone 2 and includes means for fastening the cone 2 and shaft 13 in fixed relationship. The elements 8 have a helical shape which corresponds to that of the ribs 2*a* on the internal cone. The shaft 13 may be freely guided from above or may be constrainedly guided by the use of a frame (not shown) connected to the general fixed frame. As the cone 2 and shaft 13 are non-rotatable, so also is each of the elements 8.

The arrangement of the screw elements 8 and 18 is as indicated in FIG. 1 where *a* indicates the raised portions and *b* indicates the lower portions.

The toothed support 5 is mounted on a shaft 9 which is non-rotatable but moveable in a verticle direction. The member 10 includes a collar which may be keyed with the shaft 9 to prevent rotation thereof but permit limited axial movement of shaft 9. Shaft 9 is supported at its lower end by means of an adjusting member including base 12, spring 11 and handle 15. Upon rotation of handle 15 the shaft 9 can be raised or lowered. This in turn causes the toothed support 5 to be raised or lowered and the cone 2 to also be raised or lowered.

The material that has been ground issues from the base of the cones onto an annular floor 16 which is fixed to a rotary portion of the abutment 3. The abutment 3 carries the external cone 1, and a scraper 17 is provided to discharge the material towards a collecting duct (not shown).

Having described one embodiment for the grinding mill of this invention, that which is to be secured by letters patent is defined in the following claims:

I claim:

1. A grinding mill comprising two coaxial cones, means for mounting said cones in telescopic relationship so that the distance between the walls of the cones is smallest at the base of the cones, the outer cone being rotatable and having internal helical ribs and the inner cone being stationary and having external helical ribs, the ribs on one cone crossing the ribs on the other cone so that material passing between the two cones is conveyed from the apex to the base of the cones.

2. The mill of claim 1 including means defining an inlet for the material to be ground, the inlet containing means defining helical sets of ribs to force the material in the inlet towards the two cones disposed therebelow.

3. The mill of claim 2 including a shaft extending from said inner cone coaxial with said inlet, a first set of inwardly extending ribs formed on the internal wall of the means defining an inlet and a second set of ribs formed on said shaft.

4. The mill of claim 1 including a means for rotating said external cone.

* * * * *